US009359902B2

(12) United States Patent
Campbell, Jr. et al.

(10) Patent No.: US 9,359,902 B2
(45) Date of Patent: Jun. 7, 2016

(54) TURBINE AIRFOIL WITH AMBIENT COOLING SYSTEM

(71) Applicants: Christian X. Campbell, Jr., Charlotte, NC (US); John J. Marra, Winter Springs, FL (US); Jan H. Marsh, Orlando, FL (US)

(72) Inventors: Christian X. Campbell, Jr., Charlotte, NC (US); John J. Marra, Winter Springs, FL (US); Jan H. Marsh, Orlando, FL (US)

(73) Assignee: Siemens Energy, Inc., Orlando, FL (US)

( * ) Notice: Subject to any disclaimer, the term of this patent is extended or adjusted under 35 U.S.C. 154(b) by 506 days.

(21) Appl. No.: 13/930,479

(22) Filed: Jun. 28, 2013

(65) Prior Publication Data

US 2015/0003999 A1 Jan. 1, 2015

(51) Int. Cl.
*F01D 5/18* (2006.01)

(52) U.S. Cl.
CPC ..... *F01D 5/187* (2013.01); *F01D 5/186* (2013.01); *F05D 2260/22141* (2013.01)

(58) Field of Classification Search
CPC ..... F01D 5/187; F01D 25/12; F01D 9/065; F01D 5/082; F05D 2260/22141
USPC ..... 416/92
See application file for complete search history.

(56) References Cited

U.S. PATENT DOCUMENTS 2,675,208 A * 4/1954 Weinberg ..... F01D 5/147 416/233
2,906,494 A 9/1959 McCarty et al.
3,164,367 A 1/1965 Lynch
3,635,585 A 1/1972 Metzler, Jr.
3,782,108 A 1/1974 Holste
3,807,892 A 4/1974 Frei et al.
3,844,679 A 10/1974 Grondahl et al.
3,930,748 A 1/1976 Redman et al.
3,936,215 A 2/1976 Hoff
4,113,406 A 9/1978 Lee et al.
4,153,386 A 5/1979 Leogrande et al.
4,753,575 A 6/1988 Levengood et al.
4,930,980 A 6/1990 North et al.
5,012,646 A 5/1991 Speer
5,249,934 A 10/1993 Merritt et al.
5,357,742 A 10/1994 Miller
5,387,085 A 2/1995 Thomas et al.
5,480,284 A 1/1996 Wadia et al.
5,702,232 A 12/1997 Moore (Continued)

FOREIGN PATENT DOCUMENTS

EP 1541805 A1 6/2005
EP 2141336 A2 * 1/2010 ..... F02C 6/08

(Continued)

*Primary Examiner* — Ninh H Nguyen
*Assistant Examiner* — Jesse Prager

(57) ABSTRACT

A turbine airfoil usable in a turbine engine and having at least one ambient air cooling system is disclosed. At least a portion of the cooling system may include one or more cooling channels configured to receive ambient air at about atmospheric pressure. The ambient air cooling system may have a tip static pressure to ambient pressure ratio of at least 0.5, and in at least one embodiment, may include a tip static pressure to ambient pressure ratio of between about 0.5 and about 3.0. The cooling system may also be configured such that an under root slot chamber in the root is large to minimize supply air velocity. One or more cooling channels of the ambient air cooling system may terminate at an outlet at the tip such that the outlet is aligned with inner surfaces forming the at least one cooling channel in the airfoil to facilitate high mass flow.

8 Claims, 6 Drawing Sheets

(56) References Cited

U.S. PATENT DOCUMENTS

| | | | | |
|---|---|---|---|---|
| 5,720,431 | A | 2/1998 | Sellers et al. | |
| 5,980,209 | A | 11/1999 | Barry et al. | |
| 6,004,095 | A | 12/1999 | Waitz et al. | |
| 6,578,362 | B1 | 6/2003 | Coffinberry | |
| 6,769,878 | B1 | 8/2004 | Parker et al. | |
| 6,932,573 | B2 | 8/2005 | Liang | |
| 6,948,906 | B2 | 9/2005 | Leishman et al. | |
| 7,244,101 | B2 | 7/2007 | Lee et al. | |
| 7,296,973 | B2 | 11/2007 | Lee et al. | |
| 7,413,407 | B2 | 8/2008 | Liang | |
| 7,507,071 | B2 | 3/2009 | Kopmels et al. | |
| 7,621,719 | B2 | 11/2009 | Lutjen et al. | |
| 7,677,048 | B1 | 3/2010 | Brostmeyer et al. | |
| 8,096,770 | B2 | 1/2012 | Lian | |
| 8,622,702 | B1 * | 1/2014 | Liang | F01D 5/18 416/96 R |
| 2002/0021966 | A1 | 2/2002 | Kvasnak et al. | |
| 2007/0089421 | A1 * | 4/2007 | Jangili | F01D 25/12 60/772 |
| 2010/0124483 | A1 * | 5/2010 | Weaver | F01D 5/082 415/115 |
| 2010/0254801 | A1 | 10/2010 | Tibbott | |
| 2011/0033312 | A1 * | 2/2011 | Lee | F01D 5/187 416/97 R |
| 2011/0217181 | A1 * | 9/2011 | Hada | B23P 15/02 416/97 R |
| 2013/0156579 | A1 | 6/2013 | Lee et al. | |

FOREIGN PATENT DOCUMENTS

| | | | | |
|---|---|---|---|---|
| EP | 2489838 | A2 | 8/2012 | |
| GB | 504781 | A * | 5/1939 | F01D 5/082 |
| JP | 58077127 | | 5/1983 | |

* cited by examiner

TURBINE AIRFOIL WITH AMBIENT COOLING SYSTEM

Development of this invention was supported in part by the United States Department of Energy, Advanced Turbine Development Program, Contract No. DE-FC26-05NT42644. Accordingly, the United States Government may have certain rights in this invention.

FIELD OF THE INVENTION

This invention is directed generally to turbine airfoils, and more particularly to hollow turbine airfoils having cooling channels for passing fluids, such as air, to cool the airfoils.

BACKGROUND

Typically, gas turbine engines include a compressor for compressing air, a combustor for mixing the compressed air with fuel and igniting the mixture, and a turbine blade assembly for producing power. Combustors often operate at high temperatures that may exceed 2,500 degrees Fahrenheit. Typical turbine combustor configurations expose turbine vane and blade assemblies to these high temperatures. As a result, turbine vanes and blades must be made of materials capable of withstanding such high temperatures. In addition, turbine vanes and blades often contain cooling systems for prolonging the life of the vanes and blades and reducing the likelihood of failure as a result of excessive temperatures.

Typically, turbine blades are formed from an elongated portion forming a blade having one end configured to be coupled to a turbine blade carrier and an opposite end configured to form a blade tip. The blade is ordinarily composed of a leading edge, a trailing edge, a suction side, and a pressure side. The inner aspects of most turbine blades typically contain an intricate maze of cooling circuits forming a cooling system. The cooling circuits in the blades receive air from the compressor of the turbine engine and pass the air through the ends of the blade adapted to be coupled to the blade carrier. The cooling circuits often include multiple flow paths that are designed to maintain all aspects of the turbine blade at a relatively uniform temperature. At least some of the air passing through these cooling circuits is exhausted through orifices in the leading edge, trailing edge, suction side, and pressure side of the blade. While advances have been made in the cooling systems in turbine blades, a need still exists for a turbine blade having increased cooling efficiency for dissipating heat while passing a sufficient amount of cooling air through the blade and demanding as little energy as possible from the turbine engine in the form of compressed air.

SUMMARY OF THE INVENTION

A turbine airfoil cooling system configured to cool internal and external aspects of a turbine airfoil usable in a turbine engine is disclosed. In at least one embodiment, the turbine airfoil cooling system may be configured to be included within a turbine blade. The turbine airfoil cooling system may be formed from a cooling system having one or more cooling channels configured to receive ambient air at about atmospheric pressure. The cooling system may be configured such that an under root slot chamber in the root has a ratio of attachment pitch to under root slot chamber cross-sectional area of at least 1:15. One or more cooling channels of the ambient air cooling system may terminate at an outlet at the tip such that the outlet is aligned with inner surfaces forming the at least one cooling channel in the airfoil to facilitate high mass flow. The cooling system may also be configured such that at least one of the cooling channels includes a combination of low and high friction factor augmenting cooling components to promote beneficial flow splits. The high friction factor augmenting cooling component may be a plurality of trip strip protrusions extending into the walls defining the cooling channel providing increased heat transfer, reduced flow rate and lower metal temperatures. The low friction factor augmenting cooling component may be a plurality of dimpled cooling recesses extending into the walls defining the cooling channel providing increased heat transfer, reduced flow rate and lower metal temperatures. Minimal friction may be found with use of a smooth surface.

The turbine airfoil may be formed from a generally elongated hollow airfoil formed from an outer wall having a leading edge, a trailing edge, a pressure side, a suction side, a root at a first end of the airfoil and a tip at a second end opposite to the first end. The turbine airfoil may also include an ambient air cooling system positioned within interior aspects of the generally elongated hollow airfoil. One or more cooling channels of the ambient air cooling system in the generally elongated hollow airfoil may extend radially outward from an inlet at a proximal end of the root. An under root slot chamber within the root may have a ratio of attachment pitch to under root slot chamber cross-sectional area of at least 1:15. The attachment pitch may be at least as great as 45 millimeters, and the under root slot chamber cross-sectional area may be at least as great as 675 square millimeters. In another embodiment, the under root slot chamber in the root may have a ratio of attachment pitch to under root slot chamber cross-sectional area of at least 1:25. The attachment pitch may be at least as great as 50 millimeters, and the under root slot chamber cross-sectional area may be at least as great as 1125 square millimeters.

In yet another embodiment, the under root slot chamber in the root has a ratio of attachment pitch to under root slot chamber cross-sectional area of at least 1:26. The attachment pitch may be at least as great as 58 millimeters, and the under root slot chamber cross-sectional area may be at least as great as 1520 square millimeters.

One or more of the cooling channels of the ambient air cooling system may terminate at an outlet at the tip. The outlet may be aligned with inner surfaces forming the cooling channel in the airfoil. A cross-sectional area of the outlet may be equal to a cross-sectional area of the cooling channel in the airfoil. In one embodiment, the ambient air cooling system may be formed from a plurality of cooling channels extending from the root to the tip and terminating at an outlet at the tip of the airfoil. In yet another embodiment, the ambient air cooling system may be formed from at least three cooling channels extending from the root to the tip and terminating at an outlet at the tip of the airfoil. The outlet may be aligned with inner surfaces forming the cooling channels in the airfoil. At least one of the cooling channels may include a plurality of dimpled cooling recesses in inner surfaces forming the cooling channel.

An advantage of this invention is that the cooling system uses ambient air to cool the blade, thereby reducing the overall need for pressurized air from the compressor and increasing the efficiency of the turbine engine.

Another advantage of using ambient cooling fluids is that ambient cooling air is colder than compressed air from a compressor in a gas turbine engine and thus has more capacity for cooling.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 1:
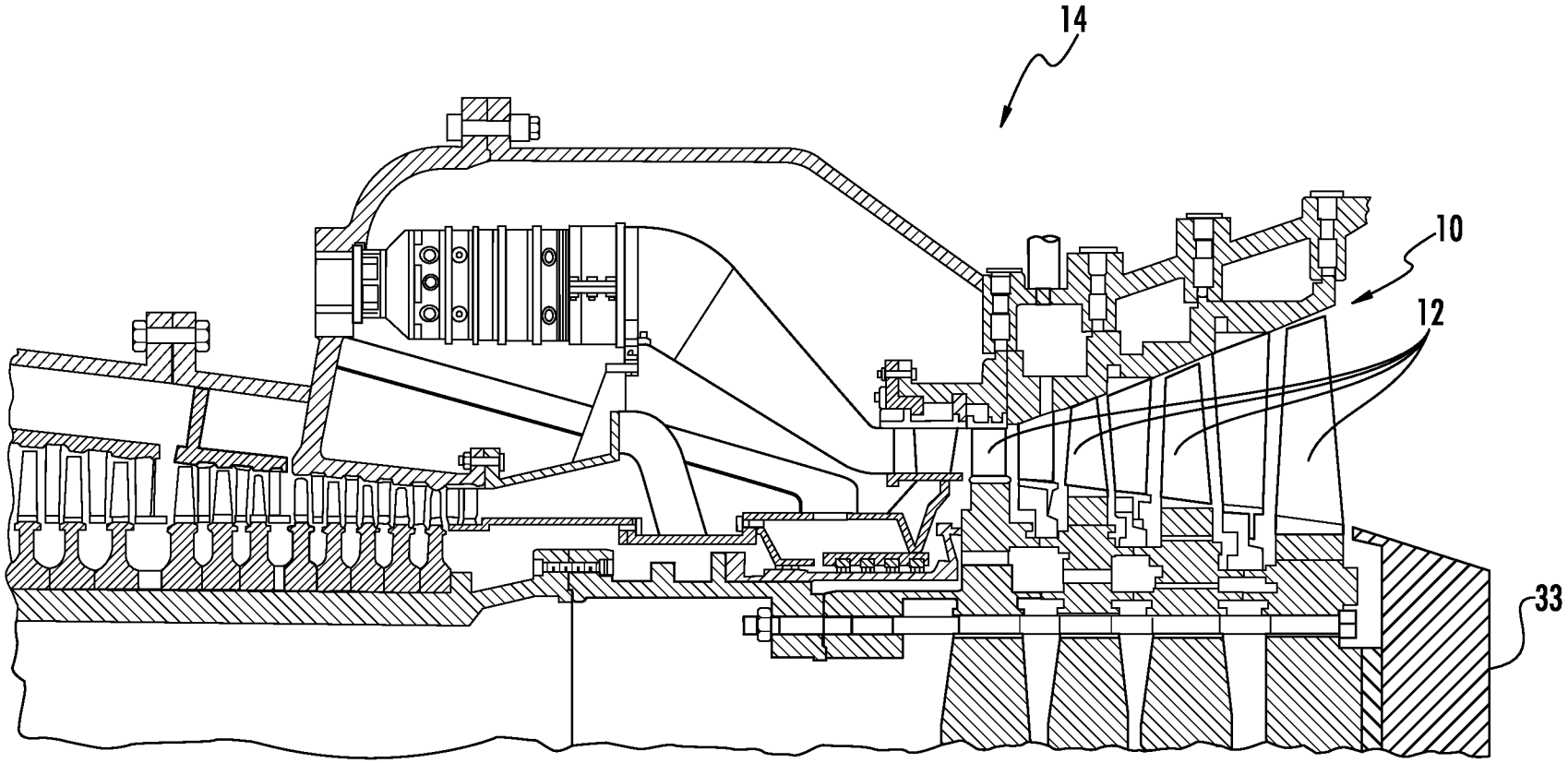
FIG. 1 is a perspective view of a turbine airfoil having features according to the instant invention.
Figure 2:
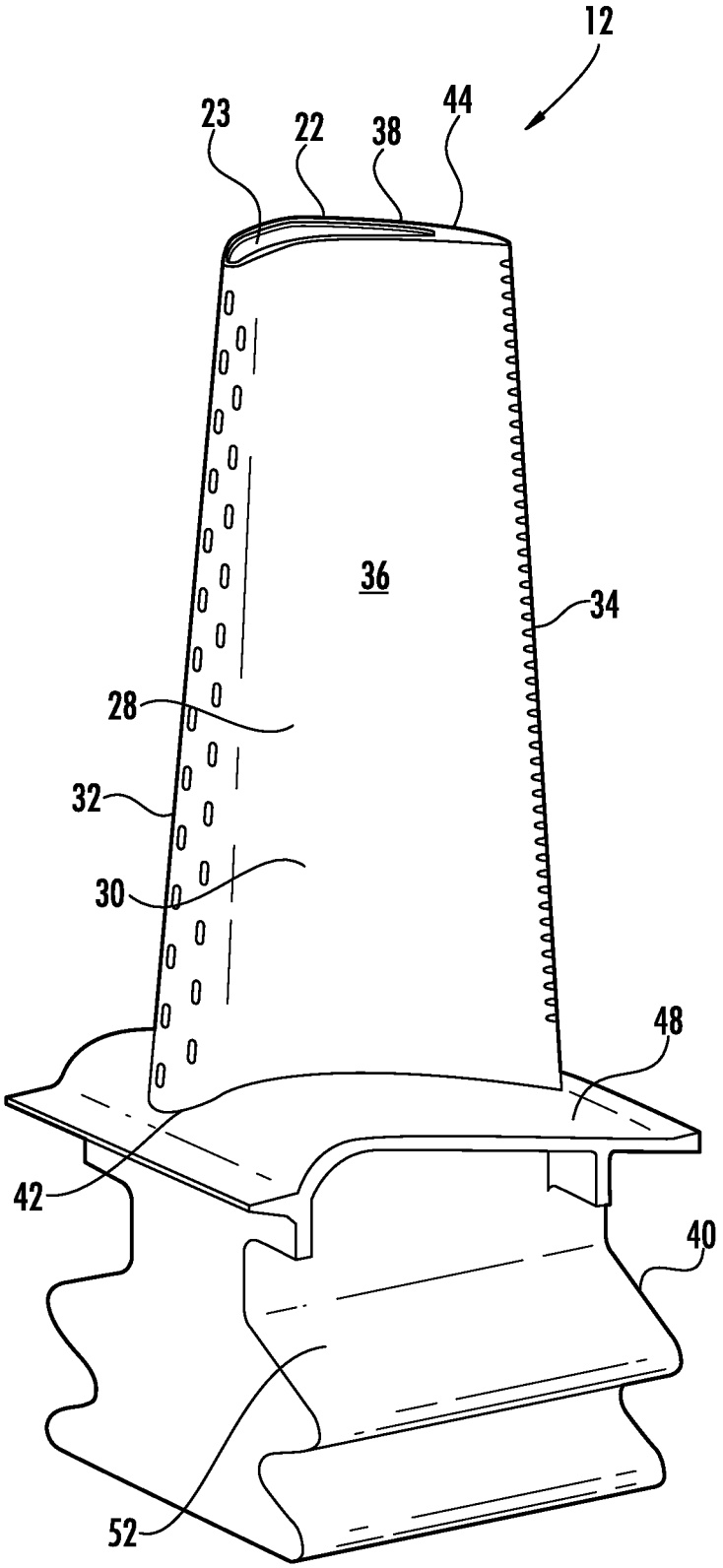
FIG. 2 is a perspective view of a turbine airfoil shown in FIG. 1.

As shown in FIGS. 1-7, this invention is directed to a turbine airfoil cooling system 10 configured to cool internal and external aspects of a turbine airfoil 12 usable in a turbine engine. In at least one embodiment, the turbine airfoil cooling system 10 may be configured to be included within a turbine blade, as shown in FIGS. 2-6. The turbine airfoil cooling system 10 may be formed from a cooling system 10 having one or more cooling channels 16 having any appropriate configuration, as shown in FIGS. 2-6. At least a portion of the cooling system 10 may include one or more cooling channels 16 configured to receive ambient air at about atmospheric pressure. The cooling system 10 may be configured such that an under root slot chamber 54 in the root has a ratio of attachment pitch 56 to under root slot chamber cross-sectional area 58 of at least 1:15. One or more cooling channels 16 of the ambient air cooling system 10 may terminate at an outlet 20 at the tip 22 such that the outlet 20 is aligned with inner surfaces 24 forming the at least one cooling channel 16 in the airfoil 12 to facilitate high mass flow. The cooling system 10 may also be configured such that at least one of the cooling channels 16 includes a combination of low and high friction factor augmenting cooling components 29, 31 to promote beneficial flow splits. The high friction factor augmenting cooling component 31 may be a plurality of trip strip protrusions extending from the walls defining the cooling channel 16 providing increased heat transfer, reduced flow rate and lower metal temperatures. The low friction factor augmenting cooling component 29 may be a plurality of dimpled cooling recesses extending into the walls defining the cooling channel 16 providing increased heat transfer, reduced flow rate and lower metal temperatures. Minimal friction may be found with use of a smooth surface 24.

The turbine airfoil 12 has a generally elongated hollow airfoil 28 formed from an outer wall 30. The generally elongated hollow airfoil 28 may have a leading edge 32, a trailing edge 34, a pressure side 36, a suction side 38, a root 40 at a first end 42 of the airfoil 20 and a tip 22 at a second end 44 opposite to the first end 42. The generally elongated hollow airfoil 28 may have any appropriate configuration and may be formed from any appropriate material. The cooling system 10 may be positioned within interior aspects of the generally elongated hollow airfoil. One or more cooling channels 16 of the cooling system 10 may be positioned in the generally elongated hollow airfoil 28 and formed from an inner surface 24. The inner surface 24 may define the cooling channel 16. The cooling channel 16 may have any appropriate cross-sectional shape. The cooling channel 16 may be positioned at the leading edge 32, a mid-chord section 46, or the trailing edge 34.

Figure 3:
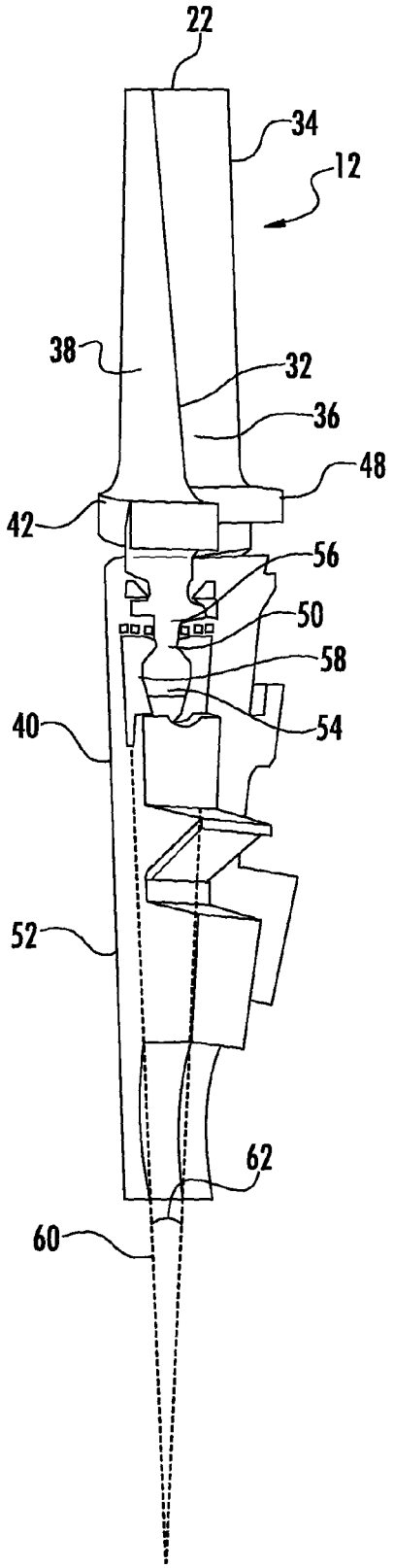
FIG. 3 is a perspective view along a leading edge of an airfoil incorporating aspects of the present invention.
Figure 4:
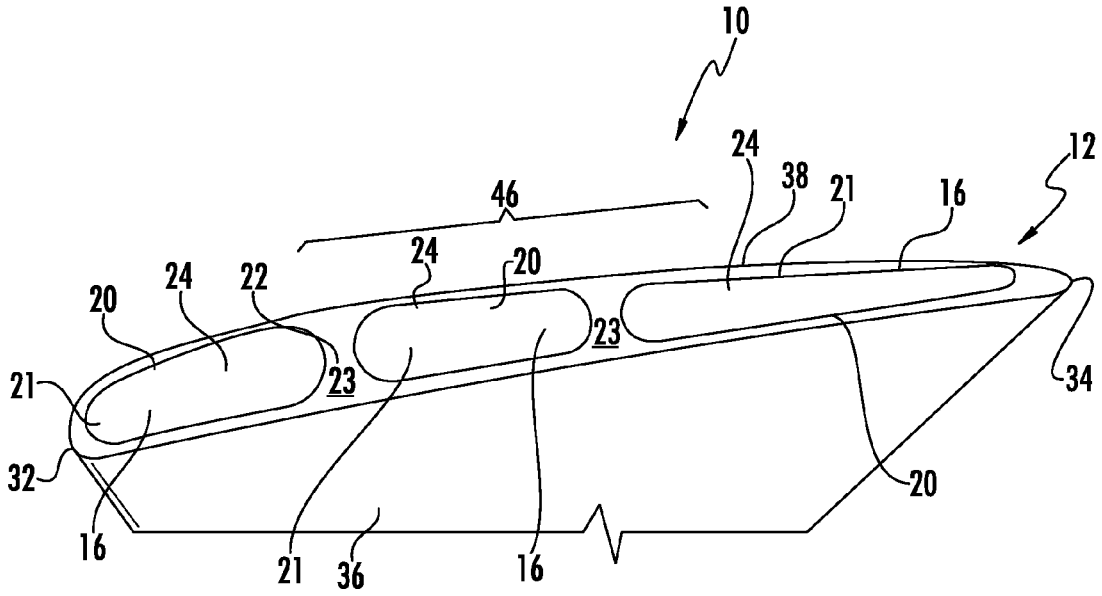
FIG. 4 is a partial detailed view of the tip of the turbine airfoil shown in FIG. 2.
Figure 5:
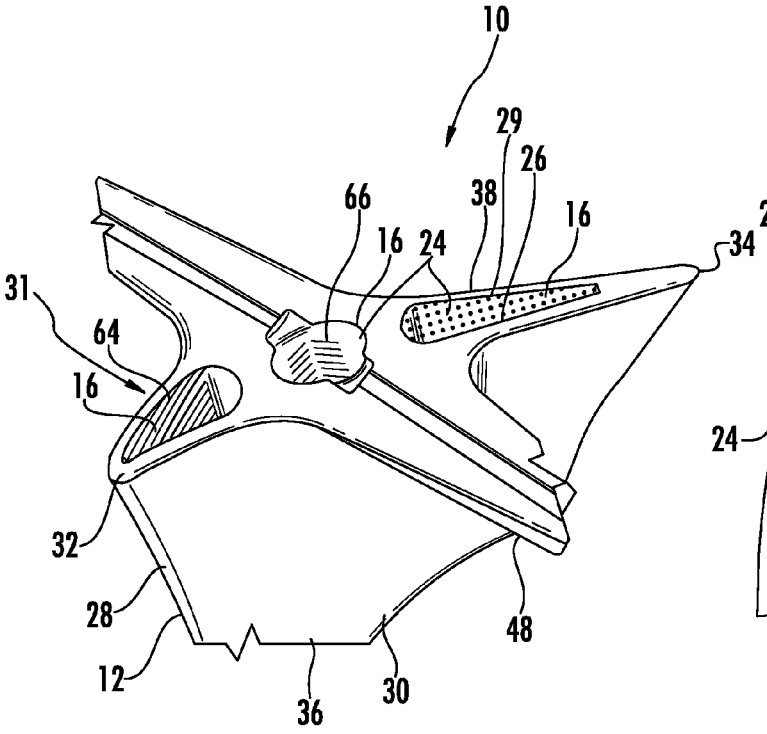
FIG. 5 is a perspective radial top view of an airfoil incorporating aspects of the present invention.
Figure 6:
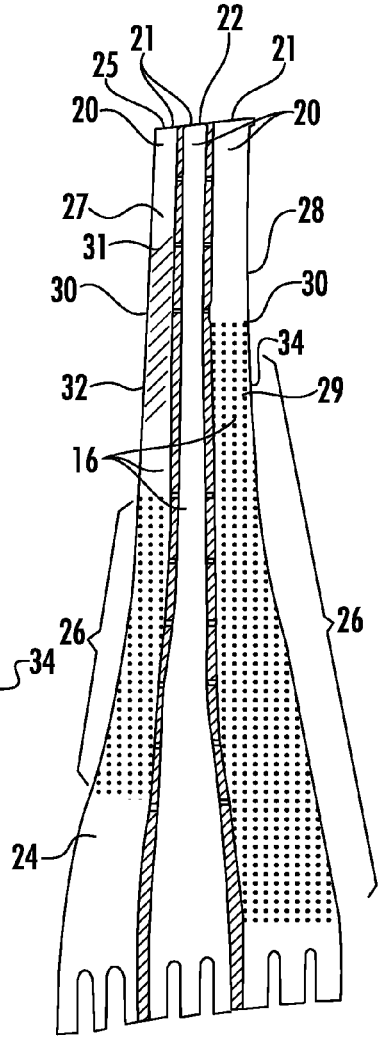
FIG. 6 is a span-wise cross-sectional view of an airfoil incorporating aspects of the present invention.

As shown in FIG. 3, the root 40 may extend radially inward from a platform 48 that extends axially from the airfoil 28 and separates the root 40 from the generally elongated hollow airfoil 28. The cooling system 10 may include one or more root cooling fluid channels 50 positioned within the root 40 and defined by inner surfaces 24 of the outer walls 52 forming the root 40. The root cooling fluid channel 50 may be tapered. In at least one embodiment, the root cooling fluid channel 50 may increase in cross-sectional area measured axially when moving radially outward toward the airfoil tip 22. The area of the root cooling fluid channel 50 immediately radially inward of the platform 48 is the under root slot chamber 54. The size of the under root slot chamber 54 may be larger than conventional root cooling channels to provide sufficient air flow without a large pressure drop.

It is advantageous to have as little pressure drop as possible through the cooling system 10. The cooling system 10 may include a number of characteristics that enable high mass flow rates in the ambient air cooling system 10. For example, the cooling system 10 may be included with a turbine airfoil 12 having sufficient size to produce a significant pumping power. The cooling channel 16 inside the blade 12 may be sized and contoured to prevent air flow from choking as it approaches sonic velocity. Choking of the air flow through the cooling system 10 should be avoided.

The cooling system 10 may be used in turbine airfoils 12 having an expansion ratio of about 20 percent or more. The mass flow rate at Mach 0.1 may be about 33 $kg/m^2$ per second at 167 degrees Celsius with a cooling fluid density of 0.790 $kg/m^3$. In one embodiment, the cooling system 10 may be used in turbine airfoils 12 having a compression ratio of about 35 percent. The turbine engine 14 may also include a high blade count to achieve high stage efficiency, a relatively large under root slot chamber 54 to pass sufficient quantities of low density air, cooling channels 16 in the airfoil 12 and root cooling fluid channels 50 within the root 40 having low pressure drop features, and cooling channels 16 having completely unobstructed openings 21 at the outlet 20 at the blade tip 22 to maximize airflow. Combining these features together in the cooling system 10 has been found to be highly effective at driving the ambient air cooling system 10 with minimal need for external force on the air for flow.

The ambient air cooling system 10 may have a tip static pressure to ambient pressure ratio of between about 0.5 and about 3.0. The tip static pressure may be measured in the cooling channel 16 at the outlet 20, and the ambient pressure ratio may be measured outside of the turbine engine in which the ambient air cooling system 10 is positioned. The cooling channel 16 of the ambient air cooling system 10 may terminate at an outlet 20 at an outer surface 23 of the tip 22. The outlet 20 may be aligned with inner surfaces 24 forming the cooling channel 16 in the airfoil 12. A cross-sectional area 25 of the outlet 20 may be equal to a cross-sectional area 27 of the cooling channel 16 in the airfoil 12.

The cooling system 10 may also be configured such that at least one of the cooling channels 16 includes a combination of low and high friction factor augmenting cooling components 29, 31 to promote beneficial flow splits. The high friction factor augmenting cooling component 31 may be a plurality of trip strip protrusions extending from the walls defining the cooling channel 16 providing increased heat transfer, reduced flow rate and lower metal temperatures. The low friction factor augmenting cooling component 29 may be a plurality of dimpled cooling recesses extending into the walls defining the cooling channel 16 providing increased heat transfer, reduced flow rate and lower metal temperatures. Minimal friction may be found with use of a smooth surface 24.

The cooling system 10 may also include a preswirler 33 positioned upstream from the cooling channel 16 of the ambient air cooling system 10 in the generally elongated hollow airfoil 28. The preswirler 33 rotates the inbound ambient air to better load the ambient air into the cooling system 10 within the turbine airfoils 12. The preswirler 33 may have any appropriate configuration to rotate the ambient air. In at least one embodiment, the preswirler 33 may be formed from a plurality of radially extending blades for increasing the rotational velocity of the ambient air.

Figure 7:
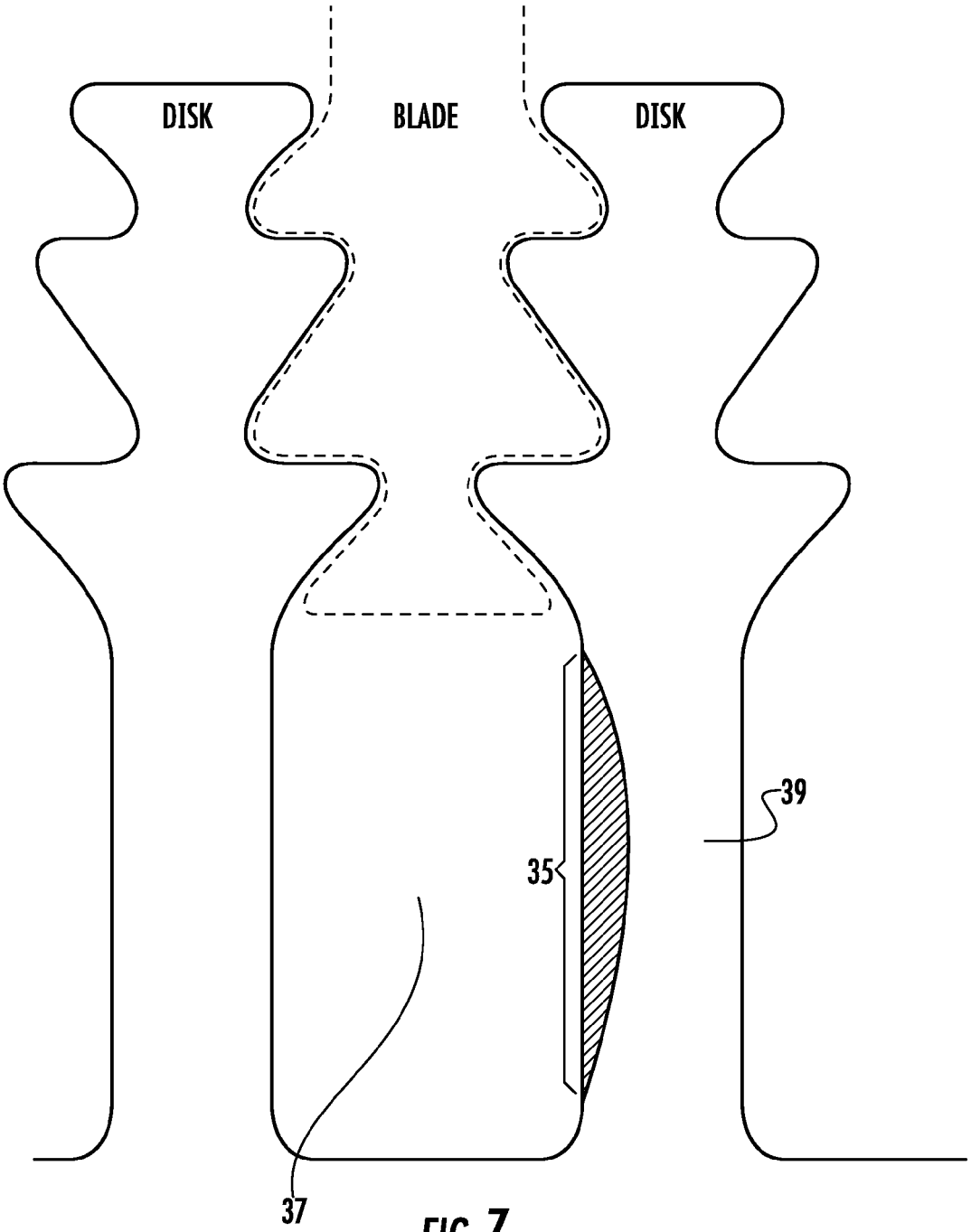
FIG. 7 is a partial cross-sectional view of the root of a turbine blade coupled to disks of a turbine rotor assembly and positioned radially outward from an underroot slot.

The cooling system 10 may also include a scalloped disc 35, as shown in FIG. 7. The scalloped disc 35 may be positioned in an aft end of a disk 39 to promote flow into the underroot slot 37. The scalloped disc 35 functions as a scoop to scoop or load air into the cavities in the disk under the blade roots. The scalloped disc 35 may include one or more scallops that may extend into disc a distance that does not impact the structural integrity of the disc 35. In at least one embodiment, the scalloped disc 35 may extend into the disc 39 less than 40 percent.

A size of the under root slot chamber 54 may be quantified by describing a ratio of the attachment pitch 56 to under root slot chamber cross-sectional area 58. The attachment pitch 56 is equal to a (radius*sin(angle)), wherein the radius is radius 60 and the angle is angle 62. The under root slot chamber cross-sectional area 58 is taken within the under root slot chamber 54. In one embodiment, the under root slot chamber 54 within the root 40 may have a ratio of attachment pitch 56 to under root slot chamber cross-sectional area 58 of at least 1:15. The attachment pitch 56 may be at least as great as 45 millimeters, and the under root slot chamber cross-sectional area 58 may be at least as great as 675 square millimeters. In another embodiment, the under root slot chamber 54 in the root 40 may have a ratio of attachment pitch 56 to under root slot chamber cross-sectional area 58 of at least 1:25. The attachment pitch 56 may be at least as great as 50 millimeters, and the under root slot chamber cross-sectional area 58 may be at least as great as 1125 square millimeters. In yet another embodiment, the under root slot chamber 54 in the root 40 may have a ratio of attachment pitch 56 to under root slot chamber cross-sectional area 58 of at least 1:26. The attachment pitch 56 may be at least as great as 58 millimeters, and the under root slot chamber cross-sectional area 58 may be at least as great as 1520 square millimeters.

The cooling system 10 may include one or more cooling channels 16 positioned in the generally elongated hollow airfoil 28 and extending radially outward from the under root slot chamber 54 at a proximal end of the root 40. The cooling channel 16 of the ambient air cooling system 10 may terminate at an outlet 20 at the tip 22. The outlet 20 may be aligned with inner surfaces 24 forming the cooling channels 16 in the airfoil 28. A cross-sectional area of the outlet 20 may be equal to a cross-sectional area of the cooling channel 16 in the airfoil 28. In one embodiment, the ambient air cooling system 10 may include a plurality of cooling channels 16, such as, but not limited to three cooling channels 16. The least three cooling channels 16 may extend from the root 40 to the tip 22 and may terminate at an outlet 20 at the tip 22 of the airfoil 28. The outlet may be aligned with inner surfaces 24 forming the cooling channels 16 in the airfoil 28. The open tip 22 configuration described herein enables the turbine airfoil 12 to achieve high mass flow of cooling fluids through the cooling fluid system 10. The tip 22 is also rub tolerant because any rubbing that occurs with a corresponding ring segment does not change the effectiveness of the blade tip 22 and thus is less susceptible to damage.

The cooling system 10 may also be configured such that at least one of the cooling channels 16 includes a combination of low and high friction factor augmenting cooling components 26 to promote beneficial flow splits. The high friction factor augmenting cooling component 31 may be a plurality of trip strip protrusions extending from the walls defining the cooling channel 16 providing increased heat transfer, reduced flow rate and lower metal temperatures. The high friction factor augmenting cooling component 31 may be formed from turbulators 64, broken, V-shaped turbluators, broken V-shaped turbulators 66 and the like. The high friction factor augmenting cooling component 31 is not limited to a single configuration but may be formed from any appropriate configuration providing the desired pressure and cooling profiles.

The low friction factor augmenting cooling component 29 may be a plurality of dimpled cooling recesses extending into the walls defining the cooling channel 16 providing increased heat transfer, reduced flow rate and lower metal temperatures. Minimal friction may be found with use of a smooth surface 24. One or more cooling channels 16 may include a plurality of dimpled cooling recesses 26 in the inner surfaces 24 forming cooling channel 16. The dimpled cooling recesses may have any appropriate configuration. The dimpled recesses 26 may be aligned into spanwise extending or cordwise extending rows. Alternatively, the dimpled recesses 26 may be positioned into rows with alternating rows offset from adjacent dimpled recess rows. The dimpled cooling recesses 26 may extend from the root 40 to the tip 22 or any portion in between.

During use, the cooling fluids may be passed into the cooling system 16 via cooling channel 16 in the root 40. The cooling fluids may flow into the under root slot chamber 54 and into the channel 16 in the airfoil 28. The cooling fluids increase in temperature from convection occurring while the cooling fluids reside within the cooling system 10. Cooling air will accellerate due to the pumping action imparted by the centrifugal forces of blade rotation. The cooling fluids are exhausted from the cooling system 10 through outlet 20 at the tip 22 of the hollow airfoil 28.

The foregoing is provided for purposes of illustrating, explaining, and describing embodiments of this invention. Modifications and adaptations to these embodiments will be apparent to those skilled in the art and may be made without departing from the scope or spirit of this invention.

We claim:

1. A turbine airfoil, comprising:

a generally elongated hollow airfoil formed from an outer wall, and having a leading edge, a trailing edge, a pressure side, a suction side, a root at a first end of the airfoil and a tip at a second end opposite to the first end, and an ambient air cooling system positioned within interior aspects of the generally elongated hollow airfoil;

at least one cooling channel of the ambient air cooling system in the generally elongated hollow airfoil extending radially outward from an inlet at a proximal end of the root, the at least one cooling channel being configured to receive ambient air at atmospheric pressure;

wherein the ambient air cooling system has a tip static pressure to ambient pressure ratio of at least 0.5; and wherein the ambient air cooling system comprises a plurality of cooling channels extending from the root to the tip and terminating at an outlet at the tip of the airfoil, wherein the outlet at an outer surface of the tip is aligned with inner surfaces forming the cooling channels in the airfoil, wherein at least one of the cooling channels includes a combination of low and high friction factor augmenting cooling components to promote beneficial flow splits.

2. The turbine airfoil of claim 1, wherein the ambient air cooling system has a tip static pressure to ambient pressure ratio of between 0.5 and 3.0.

3. The turbine airfoil of claim 1, wherein the at least one cooling channel of the ambient air cooling system terminates at an outlet at an outer surface of the tip, wherein the outlet is aligned with inner surfaces forming the at least one cooling channel in the airfoil.

4. The turbine airfoil of claim 3, wherein a cross-sectional area of the outlet is equal to a cross-sectional area of the at least one cooling channel in the airfoil.

5. The turbine airfoil of claim 1, further comprising a preswirler positioned upstream from the at least one channel of the ambient air cooling system in the generally elongated hollow airfoil.

6. The turbine airfoil of claim 1, further comprising a scalloped disc.

7. The turbine airfoil of claim 1, further comprising an under root slot chamber within the root having a large volume such that a ratio of attachment pitch in mm to under root slot chamber cross-sectional area in $mm^2$ is at least 1:15.

8. The turbine airfoil of claim 1, wherein an under root slot chamber in the root has a ratio of attachment pitch in mm to under root slot chamber cross-sectional area in $mm^2$ of at least 1:25.

* * * * *